US006773208B2

(12) United States Patent
DeWitt et al.

(10) Patent No.: US 6,773,208 B2
(45) Date of Patent: Aug. 10, 2004

(54) METHOD FOR CASTING A PARTIALLY REINFORCED CONCRETE PILE IN THE GROUND

(76) Inventors: Wayne DeWitt, 10816 SE. Evergreen, Vancouver, WA (US) 98664; Tyler W. DeWitt, 19500 NE. 272nd St., Battleground, WA (US) 98604

( * ) Notice: Subject to any disclaimer, the term of this patent is extended or adjusted under 35 U.S.C. 154(b) by 0 days.

(21) Appl. No.: 10/322,265

(22) Filed: Dec. 17, 2002

(65) Prior Publication Data

US 2004/0115007 A1 Jun. 17, 2004

(51) Int. Cl.[7] ..... E02D 23/00; E02D 27/34; E02D 5/20

(52) U.S. Cl. ..... 405/249; 405/232; 405/233; 405/239; 405/257; 52/169.9

(58) Field of Search ..... 405/232, 233, 405/235, 236, 239, 240, 249, 257; 52/169.9, 169.13; 175/257, 262

(56) References Cited

U.S. PATENT DOCUMENTS

| | | | | | |
|---|---|---|---|---|---|
| 1,157,443 | A | | 10/1915 | Stewart | |
| 1,477,567 | A | | 12/1923 | Lancaster | |
| 1,742,926 | A | | 1/1930 | Newton | |
| 1,873,244 | A | | 8/1932 | Zucco | |
| 2,010,778 | A | | 8/1935 | Stechert | |
| 2,326,155 | A | | 8/1943 | McCook | |
| 2,465,557 | A | | 3/1949 | Thornley | |
| 3,084,518 | A | | 4/1963 | Hochstrasser | |
| 3,309,878 | A | | 3/1967 | Lamberton | |
| 3,512,366 | A | * | 5/1970 | Turzillo | 405/241 |
| 3,568,452 | A | | 3/1971 | Stifler, Jr. | |
| 3,638,433 | A | * | 2/1972 | Sherard | 405/50 |
| 3,736,757 | A | | 6/1973 | Hartzell et al. | |
| 3,742,717 | A | | 7/1973 | Wey | |
| 3,851,484 | A | | 12/1974 | Steding | |
| 3,851,485 | A | | 12/1974 | Steding | |
| 3,869,869 | A | | 3/1975 | Pao Chen | |
| 3,971,227 | A | | 7/1976 | Godley | |
| 4,018,056 | A | | 4/1977 | Poma | |
| 4,045,966 | A | * | 9/1977 | Rusche | 405/240 |
| 4,152,089 | A | | 5/1979 | Stannard | |
| 4,158,518 | A | * | 6/1979 | Rusche | 405/240 |
| 4,269,544 | A | | 5/1981 | Rusche | |
| 4,618,289 | A | | 10/1986 | Federer | |
| 4,619,558 | A | | 10/1986 | Braatvedt | |
| 4,701,078 | A | | 10/1987 | Jse | |
| 4,992,002 | A | | 2/1991 | DeWitt | |
| 5,282,701 | A | | 2/1994 | An et al. | |
| 5,419,658 | A | | 5/1995 | DeWitt | |
| 5,501,550 | A | | 3/1996 | Calabrese | |
| 6,012,874 | A | * | 1/2000 | Groneck et al. | 405/239 |
| 6,042,304 | A | | 3/2000 | Manning | |
| 6,264,402 | B1 | * | 7/2001 | Vickars et al. | 405/239 |
| 6,382,878 | B1 | * | 5/2002 | Yang | 405/232 |
| 6,425,713 | B2 | * | 7/2002 | Fox et al. | 405/243 |
| 6,435,776 | B2 | * | 8/2002 | Vickars et al. | 405/239 |
| 6,652,195 | B2 | * | 11/2003 | Vickars et al. | 405/239 |

FOREIGN PATENT DOCUMENTS

| | | | |
|---|---|---|---|
| EP | 0 084 921 | 8/1983 | |
| EP | 0404703 | * 12/1990 | 405/236 |
| FR | 708.148 | 7/1931 | |

* cited by examiner

*Primary Examiner*—Jong-Suk (James) Lee
(74) *Attorney, Agent, or Firm*—Chernoff, Vilhauer, McClung & Stenzel

(57) ABSTRACT

A method for casting a partially-reinforced concrete pile in the ground includes installing an elongate hollow tubular casing in a hole in the ground with an elongate portion of the hole extending downwardly beneath the lower end of the casing. Hardenable fluid concrete is conducted into the hole and casing so as to substantially fill the respective hollow cross-sections thereof. The concrete is permitted to reach a hardened state while the casing remains within the ground, thereby forming a concrete pile partially reinforced by the casing against side-loading in an upper portion of the pile.

5 Claims, 2 Drawing Sheets

METHOD FOR CASTING A PARTIALLY REINFORCED CONCRETE PILE IN THE GROUND

BACKGROUND AND SUMMARY OF THE INVENTION

This invention relates to improvements in methods for casting a reinforced concrete pile in the ground, and particularly to a method for casting a partially reinforced concrete pile which is reinforced in its upper portion against side-loading from earthquakes, wind and other influences.

It has long been known to cast concrete piles in the ground, either without exterior reinforcing casings as exemplified by DeWitt U.S. Pat. No. 4,992,002, or with full-length exterior reinforcing casings as exemplified by DeWitt U.S. Pat. No. 5,419,658. When no permanent exterior reinforcing casing is provided, reinforcement against side-loading from earthquakes, wind and other influences is normally supplied by means of a steel cage assembly composed of reinforcing bars embedded in the concrete of the pile. However it is often difficult to position such a cage assembly centrally in the pile accurately enough to ensure sufficient resistance to side-loading from all lateral directions, and to provide adequate cover of the steel bars as called for in all building codes. Moreover, even if accurate positioning of the cage assembly were obtainable, its central location within the pile would not provide resistance to lateral beam stresses nearly as effectively as reinforcement located at the exterior surface of the pile. Another drawback of piles which are cast in a hole without a permanent exterior casing is that excess concrete grout must normally be pumped at the top of the hole to prevent its collapse, thereby adding to the cost of material for each pile.

The use of a full-length exterior reinforcing casing in conjunction with a cast-in-place pile is also problematic. The need to leave such a casing, usually of expensive steel construction, permanently in the ground to provide the reinforcement, coupled with the significant length of the casing, makes the cost of material for each pile excessively high. In addition, due to the poor surface friction of such a smooth casing relative to the soil, the casing must usually be driven until it reaches dense end-bearing strata in order to provide sufficient support. In contrast, the very high surface friction of a concrete pile allows for a much shorter pile, with less cost of material and less driving time.

What is needed, therefore, is a method for in-ground casting of concrete piles having reliably positioned, highly-effective reinforcement against side-loading, while minimizing the cost of material, equipment and/or time for the formation of each pile.

The foregoing and other objectives, features, and advantages of the invention will be more readily understood upon consideration of the following detailed description, taken in conjunction with the accompanying drawings.

DETAILED DESCRIPTION OF THE PREFERRED EMBODIMENTS

Figure 1:
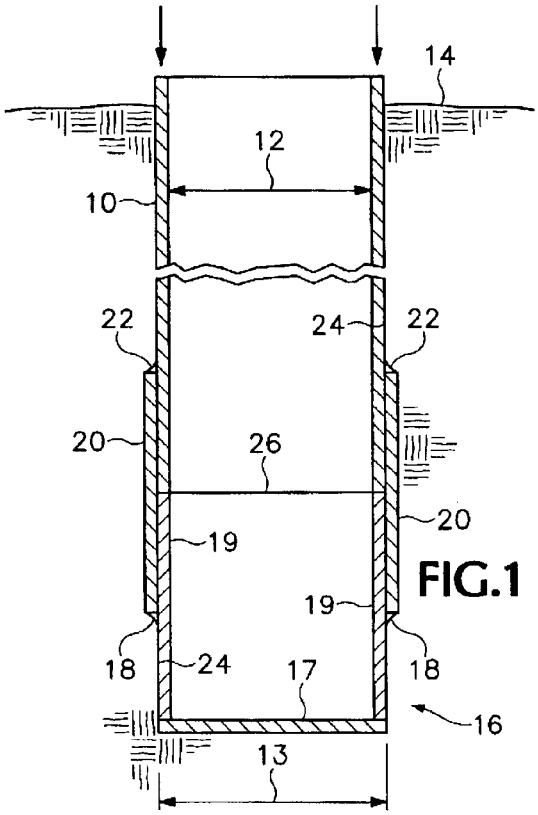
FIG. 1 is an extended cross-sectional side view showing a casing installed in the ground in accordance with one exemplary embodiment of the invention.
Figure 2:
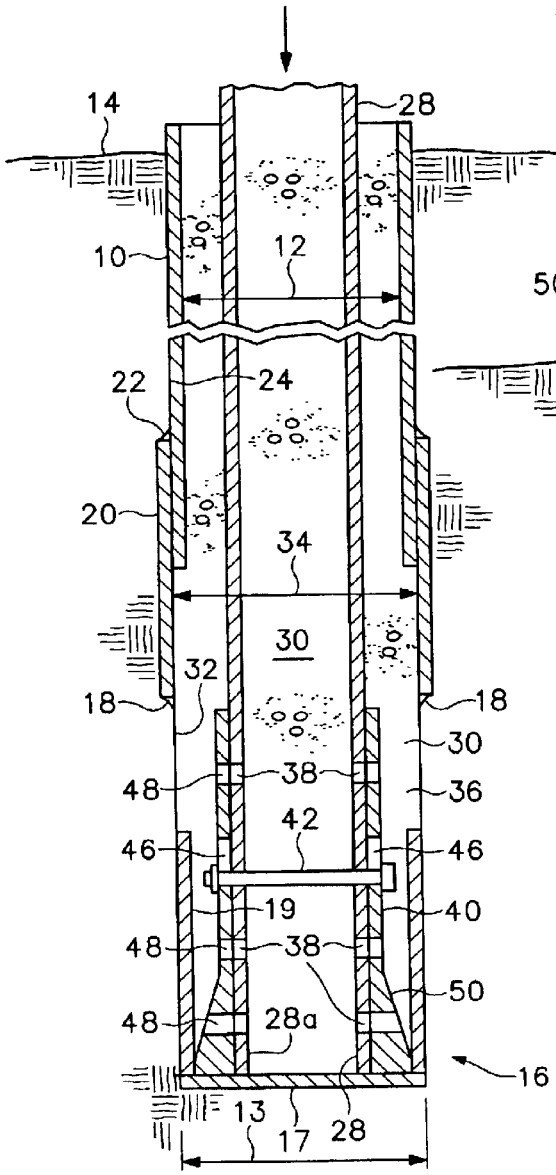
FIG. 2 is an extended cross-sectional side view showing a hollow mandrel within the casing of FIG. 1 in the process of forming an extended hole portion beneath the casing.
Figure 3:
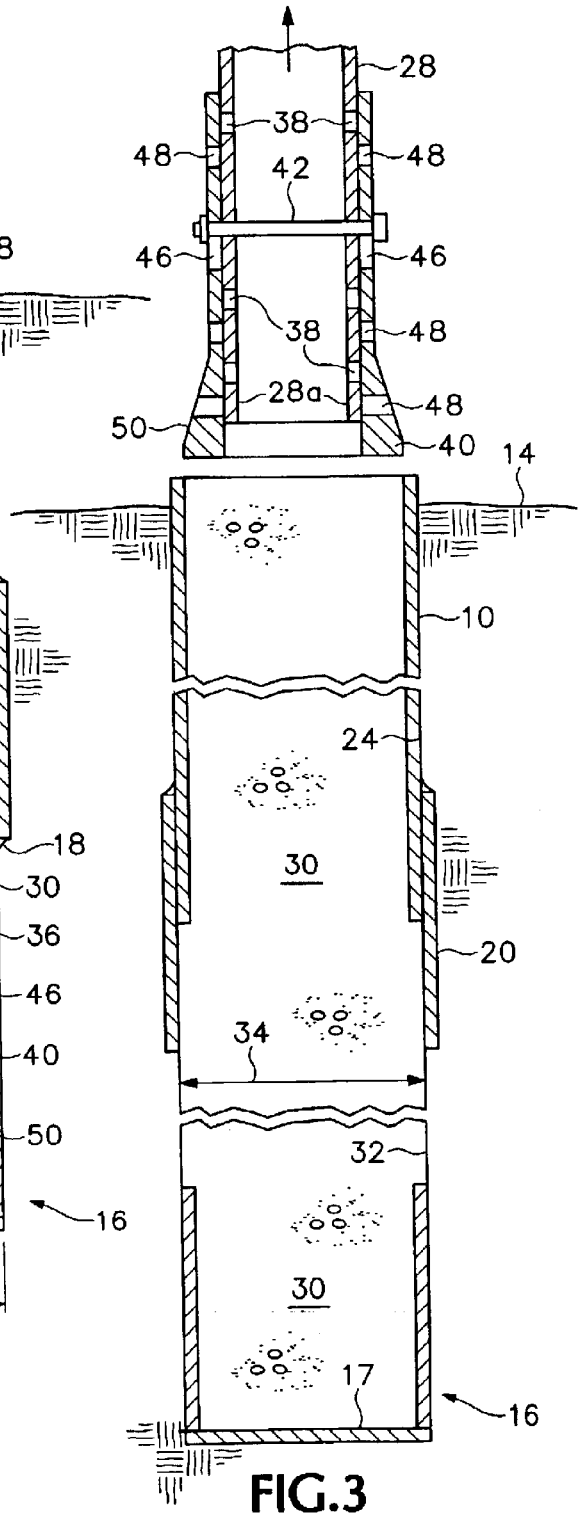
FIG. 3 is an extended cross-sectional side view showing concrete within the casing and hole of FIG. 2 after the mandrel has been withdrawn.

One preferred embodiment of a method in accordance with the present invention is depicted in FIGS. 1–3, and constitutes an improvement over a method disclosed in DeWitt U.S. Pat. No. 4,992,002 which is hereby incorporated by reference. To the extent that features shown in U.S. Pat. No. 4,992,002 are compatible with the disclosure herein, they may be used in the present invention as desired.

Figure 1A:
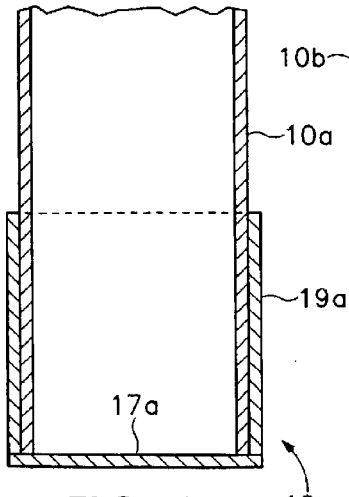
FIGS. 1A and 1B are partial cross-sectional side views showing alternative embodiments of the casing of FIG. 1.
Figure 1B:
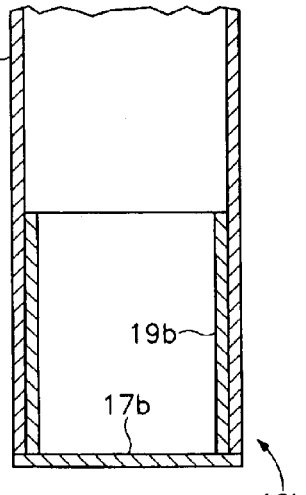

In the particular preferred embodiment shown in FIGS. 1–3, a hollow, tubular steel casing 10 having an internal hollow cross-sectional area indicated at 12 is installed in the ground 14 as shown in FIG. 1. The casing has a temporarily closed bottom end comprising a foot assembly 16 detachably connected to the lower end of the casing 10 by any suitable means. For example, in FIG. 1, the foot assembly 16 comprises a bottom plate 17 having a cross-sectional area indicated at 13, and an upper tubular wall 19 detachably connected by tack welds 18 to a sleeve 20 which in turn is connected by a permanent weld 22 to the exterior of the casing 10, so that the top of the foot assembly 16 and the lower end of the casing 10 contact each other at an abutment 26. Alternatively, a foot assembly such as 16a in FIG. 1A may be used, whereby the upper tubular wall 19*a* slidably engages the exterior of a casing 10*a*, while the bottom end of the casing engages the bottom plate 17*a* of the foot assembly. As a further alternative, a foot assembly such as 16*b* in FIG. 1B may have an upper tubular wall 19*b* which slidably engages the interior of a casing 10*b*, while the bottom end of the casing engages a peripheral portion of the bottom plate 17*b*. In any of these alternative structures, the casing is preferably installed in the ground 14 by driving its top downwardly by means of a pile driver, thereby forming a hole 24 in the ground as shown in FIG. 1. The use of a vibrator or other conventional means to install the casing 10 in the ground could also be used.

After the casing 10 has been installed as shown in FIG. 1, a strong, hollow steel mandrel 28 is inserted into the top of the casing 10 so as to rest on the bottom plate 17 of the foot assembly 16 as shown in FIG. 2. The mandrel is somewhat longer than the depth of the pile which is to be formed, and its cross-sectional shape is preferably similar to, but smaller than, the internal hollow cross-sectional area 12 of the casing 10 and the cross-sectional area 13 of the bottom plate 17 of the foot assembly 16. The casing 10, bottom plate 17, and mandrel 28 are all preferably circular in cross-section.

Located near the top of the mandrel is a supply of hardenable fluid concrete grout (not shown). With the bottom of the mandrel 28 resting on the bottom plate 17, the concrete is pumped into the mandrel to an appropriate level to form a reservoir of fluid concrete grout 30 within the mandrel, and the concrete grout flows out of the holes 38 and 48 filling the annular space 36 around the mandrel to near ground level. With such reservoir of fluid concrete in place, the mandrel is then driven downwardly by a pile driver (not shown), thereby separating the foot assembly 16 from the casing 10 by breaking the tack welds 18 as shown in FIG. 2 to begin forming an extended portion 32 of the hole 24 below the lower end of the casing 10. Due to the cross-sectional area 13 of the bottom plate 17, the resultant extended portion 32 of the hole 24 has a cross-sectional area indicated at 34 which is larger than that of the mandrel 28 and substantially at least as great as, or greater than, the internal hollow cross-sectional area 12 of the casing. As the driving of the mandrel 28 continues, the extended portion 32 of the hole 24 increases in length to a point where only a minor portion (for example 20 feet) of the total length of the hole 24 is occupied by the casing 10, and a major portion (for example 60 feet) of the length of the hole 24 constitutes the extended portion 32 below the lower end of the casing 10.

As the extended portion 32 of the hole is formed, the annular area 36 surrounding the mandrel 28 is extended by the bottom plate 17. During formation of the extended portion 32 of the hole 24, the extended annular area 36 is simultaneously filled with fluid concrete 30 conducted by gravity and fluid head pressure from the reservoir within the hollow mandrel 28 and outwardly through the concrete-transmitting apertures 38 and 48 located near the bottom of the mandrel. Simultaneously, the annular area 36 between the mandrel 28 and casing 10 may also be partially or completely filled with the concrete 30.

When the mandrel 28 has been driven to the desired pile depth, the mandrel is withdrawn from the hole and casing as shown in FIG. 3, leaving the foot assembly 16 in the hole, while further fluid concrete 30 is conducted by gravity and fluid head pressure from the reservoir within the mandrel through the bottom end 28*a* of the mandrel, which is now open due to its withdrawal from the foot assembly 16. As the mandrel is withdrawn, the extended portion 32 of the hole 24 is thus filled with fluid concrete 30 substantially throughout its cross-sectional area 34.

Also, the internal hollow cross-sectional area 12 of the casing 10 is substantially filled with fluid concrete 30 throughout the area 12, preferably partially from within the mandrel 28 during its withdrawal, and partially independently of the mandrel after its withdrawal to top off the casing 10. In this way there is less chance of inadvertently overfilling the reservoir within the mandrel 28, which would cause wasteful overfilling of the casing 10 during withdrawal of the mandrel.

The bottom of the mandrel 28 preferably includes a reaming device 40 fastened in longitudinally-sliding relationship to the mandrel by a pin 42, which fits snugly through a pair of diametrically-opposed apertures in the mandrel and slidably through a pair of elongate vertical slots 46 in the reaming device 40. The reaming device includes the concrete transmitting apertures 48, which are slidably alignable with the corresponding apertures 38 of the mandrel 28 when the bottom surface of the reaming device 40 is flush with the bottom edge of the mandrel 28 due to contact of the mandrel with the bottom plate 17 of the foot assembly 16 as shown in FIG. 2. The alignment of the concrete-transmitting apertures 38 and 48 allows the fluid concrete 30 to be conducted from within the mandrel outwardly through the apertures while the mandrel 28 is driving the foot 16 to form the extended portion 32 of the hole 24, as described previously. After driving of the mandrel has been completed, however, and the mandrel is being withdrawn from the hole leaving the foot assembly 16 behind as shown in FIG. 3, the reaming device 40 slides downwardly relative to the mandrel 28 as shown in FIG. 3 until its sliding movement is stopped by the abutment of the pin 42 with the top of the slots 46. This sliding movement misaligns all of the apertures 48 of the reaming device 40 with respect to the concrete transmitting apertures 38 of the mandrel, thereby closing the apertures 38 and preventing the passage of fluid concrete through the apertures 38 during withdrawal of the mandrel. However the fluid concrete may flow directly out the bottom 28*a* of the mandrel 28 since the bottom is no longer blocked by the bottom plate 17 of the foot assembly 16.

The purpose of the reaming device 40 is to compact, in a radially-outward direction during withdrawal of the mandrel, any soil portions which may have intruded into the hollow area 36 formed by the foot assembly 16 during formation of the extended portion 32 of the hole 24. The reaming device 40 accomplishes this by means of its frusto-conical, upwardly-facing outer peripheral surface 50. As the mandrel 28 is withdrawn from the hole, fluid concrete located above the reaming device 40 in the hollow area 36 is forced to flow vertically around the outside of the surface 50 due to the concrete's high static pressure, compressing the soil radially outwardly to an extent greater than that which would be caused merely by physical contact between the soil and the surface 50. The purpose of the misalignment and resultant closure of the concrete transmitting apertures 38 and 48 during the withdrawal process is twofold: first, such closure prevents any of the intruding soil from being forced through the apertures into the interior of the mandrel during the withdrawal process, where it would displace concrete in the core of the resulting pile and thereby weaken the pile; and, second, it prevents the concrete in the hollow area 36 surrounding the mandrel from flowing back into the interior of the mandrel during withdrawal, thereby forcing it to flow around the outside of the surface 50 of the reaming device 40. There is no danger of any concrete voids being formed below the reaming device 40 during the withdrawal process, because all areas below the reaming device are fully-exposed to the reservoir of fluid concrete 30 within the mandrel 28 through the open bottom 28*a* thereof during withdrawal.

Figure 4:
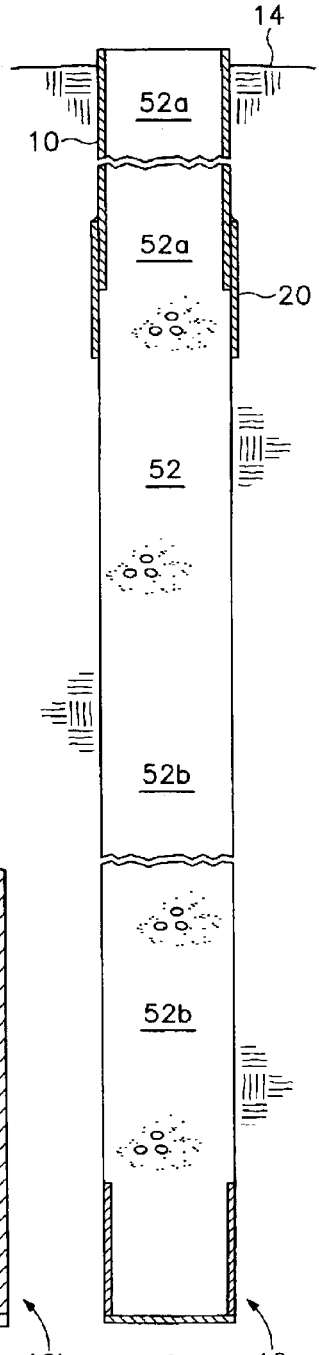
FIG. 4 is an extended cross-sectional side view showing a finished pile formed in accordance with the exemplary embodiment of FIGS. 1, 2 and 3.

After the mandrel has been withdrawn and the hole and casing are completely filled with concrete as shown in FIG. 3, the concrete within the hole and casing is permitted to reach a hardened state while the casing remains within the ground 14, thereby forming a hardened concrete pile 52 (FIG. 4) having only a minor upper portion 52*a* reinforced by the casing 10 against side-loading from earthquakes, wind and other influences, and a major lower portion 52*b* which is not reinforced by the casing 10. The major portion 52*b* below the casing 10 has a cross-sectional area either substantially as great as, or greater than, the cross-sectional area of the minor portion 52*a* within the casing 10. The sleeve 20 provides additional reinforcement for any cross-sectional change between t he two portions.

Although the method described above with respect to FIGS. 1–3 is a preferred method of casting a concrete pile in the ground partially reinforced by a casing against side-loading in an upper portion of the pile, variations of the foregoing method may be practiced alternatively, within the scope of the invention, to achieve at least most of the strength and economy advantages obtainable by the above-described method. For example, although the casing 10 is preferably installed in the ground before the extended portion 32 of the hole 24 is formed, as described above, the casing 10 could alternatively be installed in the ground after the entire hole 24 is formed, or simultaneously with the formation of the extended portion 32 of the hole, in which case there would be no need to have the foot assembly 16 detachably connected to the casing 10. As another example, although the fluid concrete is preferably conducted into the hole while simultaneously forming the extended portion 32 of the hole, such fluid concrete could be conducted into the hole after formation of the extended portion 32. This would be appropriate especially if the cross-sectional area 13 of the bottom plate 17 of the foot assembly is not larger than the cross-sectional area of the mandrel 28, which could be practical for forming relatively short piles. As another example, the reaming device 40 could be eliminated, and replaced simply by one or more lateral concrete-transmitting apertures at or near the bottom of the mandrel 28.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for casting a partially reinforced concrete pile in the ground, said method comprising:

(a) installing an elongate tubular casing, having an internal hollow cross-sectional area, and a foot assembly located adjacent a lower end of said casing, in a hole in the ground;

(b) thereafter, driving said foot assembly into the ground so as to separate said foot assembly from said casing and thereby form an extended portion of said hole between said lower end of said casing and said foot assembly;

(c) during step (b), driving said foot assembly by means of a hollow mandrel extending internally through said casing in movable relationship thereto while simultaneously forming said extended portion of said hole with a cross-sectional area larger than that of said mandrel, so as to form a hollow area surrounding said mandrel;

(d) during step (c), conducting hardenable fluid concrete through said hollow mandrel and outwardly therefrom into said hollow area surrounding said mandrel;

(e) withdrawing said mandrel from said hole and conducting further hardenable fluid concrete into said hole and casing while said casing remains within said hole; and (f) permitting said concrete within said hole and casing to reach a hardened state while said casing remains within said hole, thereby forming a concrete pile reinforced by said casing in an upper portion of said pile.

2. The method of claim 1 including forming said extended portion of said hole so as to have a length greater than that of said casing.

3. The method of claim 1 including forming said extended portion of said hole with a cross-sectional area substantially at least as great as said internal hollow cross-sectional area of said casing.

4. The method of claim 1 wherein step (d) includes conducting said fluid concrete from within said mandrel outwardly through at least one lateral opening located adjacent a lower end of said mandrel.

5. The method of claim 1 wherein said foot assembly is detachably connected to said lower end of said casing, further including detaching said foot assembly from said casing by driving said foot assembly downwardly from said casing with said mandrel.

* * * * *

UNITED STATES PATENT AND TRADEMARK OFFICE

CERTIFICATE OF CORRECTION

PATENT NO. : 6,773,208 B2
DATED : August 10, 2004
INVENTOR(S) : Wayne DeWitt et al.

It is certified that error appears in the above-identified patent and that said Letters Patent is hereby corrected as shown below:

Column 4,
Line 50, change “t he” to -- the --.

Signed and Sealed this

Fourteenth Day of December, 2004

JON W. DUDAS
*Director of the United States Patent and Trademark Office*